United States Patent [19]

Brown et al.

[11] Patent Number: 4,785,220

[45] Date of Patent: Nov. 15, 1988

[54] MULTI-CATHODE METAL VAPOR ARC ION SOURCE

[76] Inventors: Ian G. Brown, 1088 Woodside Rd., Berkeley, Calif. 94708; Robert A. MacGill, 645 Kern St., Richmond, Calif. 94805

[21] Appl. No.: 25,335

[22] Filed: Mar. 13, 1987

Related U.S. Application Data

[63] Continuation-in-part of Ser. No. 696,460, Jan. 30, 1985, Pat. No. 4,714,860.

[51] Int. Cl.[4] ..... H01J 29/04

[52] U.S. Cl. ..... 315/111.81; 315/111.91; 315/111.61; 315/111.51; 313/237; 313/231.61; 313/147

[58] Field of Search ..... 315/111.81, 111.91, 315/111.51, 111.31, 111.61; 313/237, 231.61, 147; 250/425

[56] References Cited

U.S. PATENT DOCUMENTS

| | | | |
|---|---|---|---|
| 2,677,061 | 4/1954 | Wilson | 315/111.91 |
| 3,096,435 | 7/1963 | Burdy | 250/425 |
| 3,512,030 | 5/1970 | Levy | 313/231.61 |
| 3,562,575 | 2/1971 | Paine | 313/237 |
| 3,955,118 | 5/1976 | Flemming | 315/111.81 |
| 4,496,881 | 1/1985 | Cheeve | 313/147 |
| 4,570,106 | 2/1986 | Sohval et al. | 315/111.81 |

*Primary Examiner*—David K. Moore
*Assistant Examiner*—Michael Razavi
*Attorney, Agent, or Firm*—Bielen and Peterson

[57] ABSTRACT

An ion generating apparatus utilizing a vacuum chamber, a cathode and an anode in the chamber. A source of electrical power produces an arc or discharge between the cathode and anode. The arc is sufficient to vaporize a portion of the cathode to form a plasma. The plasma is directed to an extractor which separates the electrons from the plasma, and accelerates the ions to produce an ion beam. One embodiment of the appaatus utilizes a multi-cathode arrangement for interaction with the anode.

10 Claims, 9 Drawing Sheets

270
268
286
292
328
256
276
332
288
280
274
372
348
334
366
-13-
298
284
-13-
362
286
278
254
252
306
250
282
-15-
-15
316
350
364
272
308
352
356
266
358
360

FIG-14
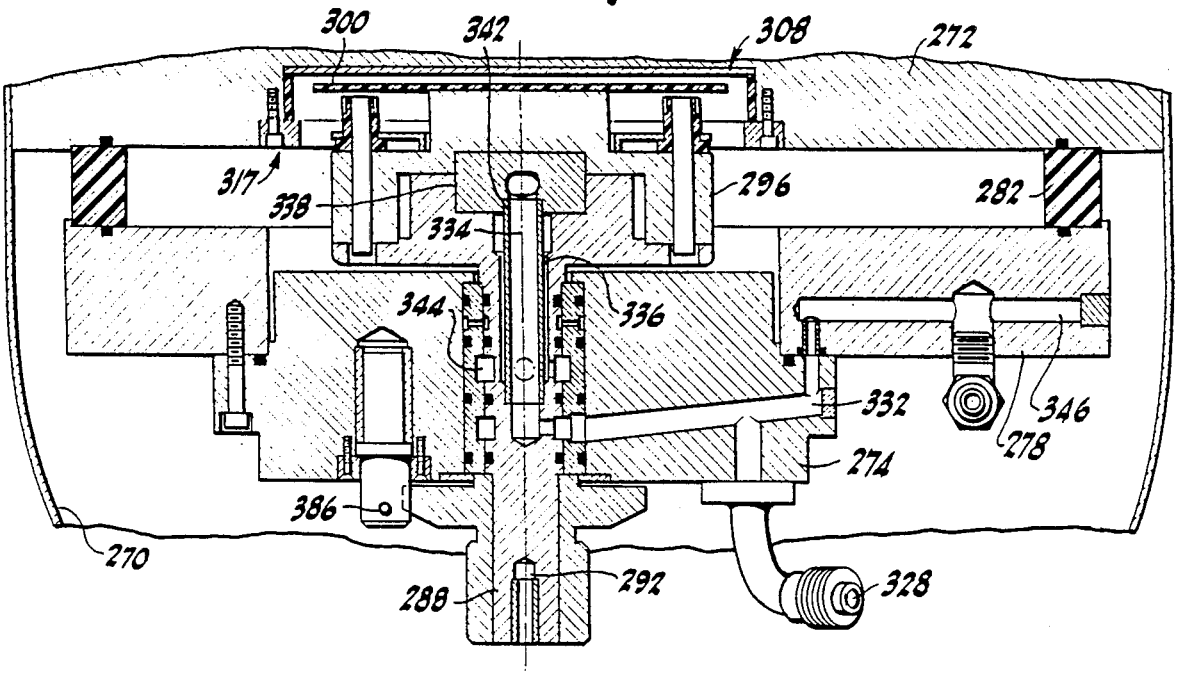
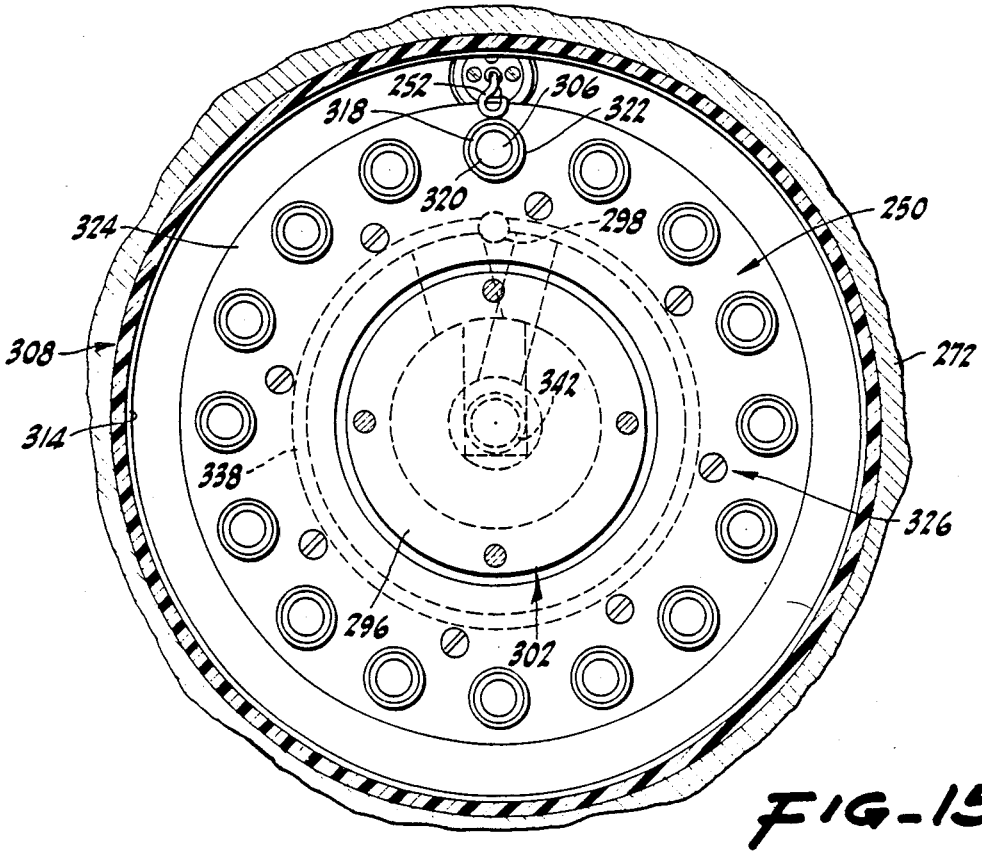
FIG-15

MULTI-CATHODE METAL VAPOR ARC ION SOURCE

STATEMENTS AS TO RIGHTS OF INVENTION MADE UNDER FEDERALLY SPONSORED RESEARCH AND DEVELOPMENT

The government has rights in this invention pursuant to contract No. DE-AC03-76SF00098 awarded by the United States Department of Energy.

CROSS-REFERENCES TO RELATED APPLICATIONS

The present invention is a continuation-in-part of application Ser. No. 696,460, filed Jan. 30, 1985 issued as U.S. Pat. No. 4,714,860, on Dec. 22, 1987.

BACKGROUND OF THE INVENTION

The present invention relates to a novel ion generating apparatus.

Ion beams have been created in many ways in the prior art. Ion species that are gaseous may be formed by creating a plasma from the gaseous source and extracting ions therefrom to create an ion beam. However, when the desired ion species is metallic, the problem exists in producing a plasma from the metal. In the past, hot metal vapor has been produced by elevating the metallic source to a very high temperature. For example, U.S. Pat. No. 2,882,409 describes a plasma formation by heating a metallic filament. In addition, there are certain cases where metallic gases exist at or near room temperature, but these situations are rare.

Two types of ion sources typically employed in accelerators are: the

Phillips Ion Gage Ion Source (PIG) and the Duoplasmatron Ion Source.

The Duoplasmatron source forms a hot cathode arc with an intermediate electrode to constrict the discharge and to create an inhomogeneous magnetic field that concentrates the plasma near the extraction aperture in the anode. For example, U.S. Pat. No. 3,409,529 describes this type of ion source. Although the Duoplasmatron Source produces a very high ion current, it is suited for production of gaseous ions rather than metallic ions.

The PIG source utilizes two cathodes placed at the end of a cylindrical hollow anode. A magnetic field is established parallel to the anode's axis. The cathodes are set at the same negative potential with respect to the anode. Electrons created by ionization of gas atoms are accelerated toward the anode but are constrained to follow the magnetic field and are thereby prevented from moving radially to the anode. Electrons oscillate between the cathodes and continue to ionize the background gas creating enough electrons to continue the ionization process. The anode typically contains a slit and an extraction electrode external to the anode. Positive ion bombardment sputters material from the cathode to form a plasma from which ions are extracted near the anode slit. Sputtering of metallic ions may be enhanced by the addition of a separate sputtering electrode. The PIG source can be used for the creation of beams of metallic ions. However, the ion beam currents achieved using the PIG source are relatively small. U.S. Pat. No. 3,560,185 describes an ion source of this type.

U.S. Pat No. 3,389,289 describes a gun which employs powdered titanium hydride which is placed between electrodes to form a spark gap. Energizing of the electrodes this produces a plasma burst.

U.S. Pat. No. 4,320,351 shows the production of an arc plasma which is sprayed onto a silicon body or wafer. The plasma is produced by injecting a powder into an arc gas stream which melts or softens the powder and propels it toward the article to be sprayed.

An article by Gilmore and Lockwood entitled Pulsed Metallic Plasma Generator, published in the proceedings of the I.E.E.E., Volume 60, #8 of August 1972, describes the production of a plasma by a vacuum arc. This method describes the placement of two electrodes in a vaccum and the establishment of an electrical discharge between them. Material from the negative electrode is vaporized and ionized by the arc to produce a metallic plasma.

U.S. Pat. No. 4,407,712 describes a sputtering technique used to plate a hollow cathode.

None of the prior art alone or in combination has described an ion beam generator for the efficient production of high current beams of metallic ions. Such a device would be a great advance in the field of production of ion beams.

SUMMARY OF THE INVENTION

In accordance with the present invention a novel and useful apparatus for generating an ion beam is provided.

The apparatus of the present invention utilizes a vacuum chamber. A cathode constructed of the working material for a source of ions is placed in the vacuum chamber and spaced apart from an anode. The anode may be held in place by a conical member which is heat conductive. The anode includes an opening which permits passage of the plasma jet generated by the apparatus. An electrical source is applied to the anode and cathode to provide an electrical potential therebetween. Cooling may be applied to a flange end of an anode holder.

Means may be also provided for producing an electrical arc between the cathode and anode. The arc would be of sufficient magnitude to vaporize a portion of the cathode and to form a plasma which moves toward the anode and then passes through the opening in the anode. Such arc production may be initiated by a trigger electrode which may be formed concentrically with the cathode. A pulsing spark is generated between the trigger electrode and the cathode by an electrical circuit. Since the trigger electrode requires a high voltage, an insulator would be placed between the trigger electrode and the cathode. Cooling would also be applied to the cathode. A magnetic field is established to confine and guide the plasma jet from the cathode towards the anode and through the anode opening. Such a magnetic field is established by a coil that surrounds the anode opening. Such means for applying a magnetic field may also include a cooling system for the same.

Means for extracting ions from the plasma plume passing through the anode is also provided. Such extracting means may externalize in a set of grids or electrodes located a selected distance beyond the anode in the vacuum chamber. The ions extracted from the plasma jet accelerate into an ion beam.

Where cathode interchangeability is desired, a multi-cathode support may extend into the vacuum chamber. The support would be capable of transporting any one of a plurality of cathodes into position relative to a common anode for formation of the vaporizing electrical arc. The support may take the form of a rotatable member having a rotatable shaft extending outside the vacuum chamber for manual or automatic rotation. A locking gripping member may also be associated with the rotatable shaft. In addition, the initiating spark between the trigger electrode and the cathode follows a surface path between an electrode collar around the cathode and the cathode itself.

It may be apparent that a novel and useful ion generating apparatus has been described.

It is therefore an object of the present invention to provide an ion generating apparatus which employs a metal vapor arc as a source of plasma.

It is another object of the present invention to provide an ion generating apparatus which employs a high density plasma originating from a solid metal or metal compound which may be transformed into an ion beam.

Another object of the present invention is to provide an ion generating apparatus which employs a low wear cathode.

A further object of the present invention is to provide an ion generating apparatus which eliminates the sputtering process of producing a plasma and the corresponding metal buildup on an anode from the same.

Yet another object of the present invention is to provide an ion generating apparatus in which metal ions are capable of combining with gases in a vacuum chamber to "pump" the same therefrom.

Another object of the present invention is to provide an ion generating apparatus which employs a plasma which possesses a high degree of stability.

A further object of the present invention is to provide an ion generating apparatus which includes a charge state distribution for the ions which is repeatable.

There is a further object of the present invention to provide an ion generating apparatus which provides an ion beam having a low beam emittance.

Another object of the present invention is to provide an ion generating apparatus which produces an ion beam having a very high beam current.

Yet another object of the present invention is to provide an ion beam generating apparatus which produces useful currents of high charge state ion species.

Another object of the present invention is to provide an ion generating apparatus which includes a multiple cathode support which permits selection of any of number of cathodes into a plasma producing position with the anode.

A further object of the present invention is to provide an ion generating apparatus which may be operated with reduced down-time resulting from cathode wear.

Yet another object of the present invention is to provide an ion generating apparatus which includes a plurality of interchangeable cathodes of different material; each cathode being capable of producing a plasma with a single anode, in consecutive fashion.

Another object of the present invention is to provide a plasma generating apparatus which employs an initiating spark following a surface path between a cathode and a surrounding electrode.

A further object of the present invention is to provide an ion generating apparatus having multiple cathodes which may be interchanged without breaking the vacuum seal of a vacuum chamber.

The invention possesses other advantages and objects especially as concerns particular characteristics and features thereof which will become apparent as the specification continues.

BRIEF DESCRIPTION OF THE DRAWINGS

FIG. 14 is a sectional view taken along line 14—14 of FIG. 13.

FIG. 15 is a sectional view taken along line 15—15 of FIG. 11.

Figure 1:
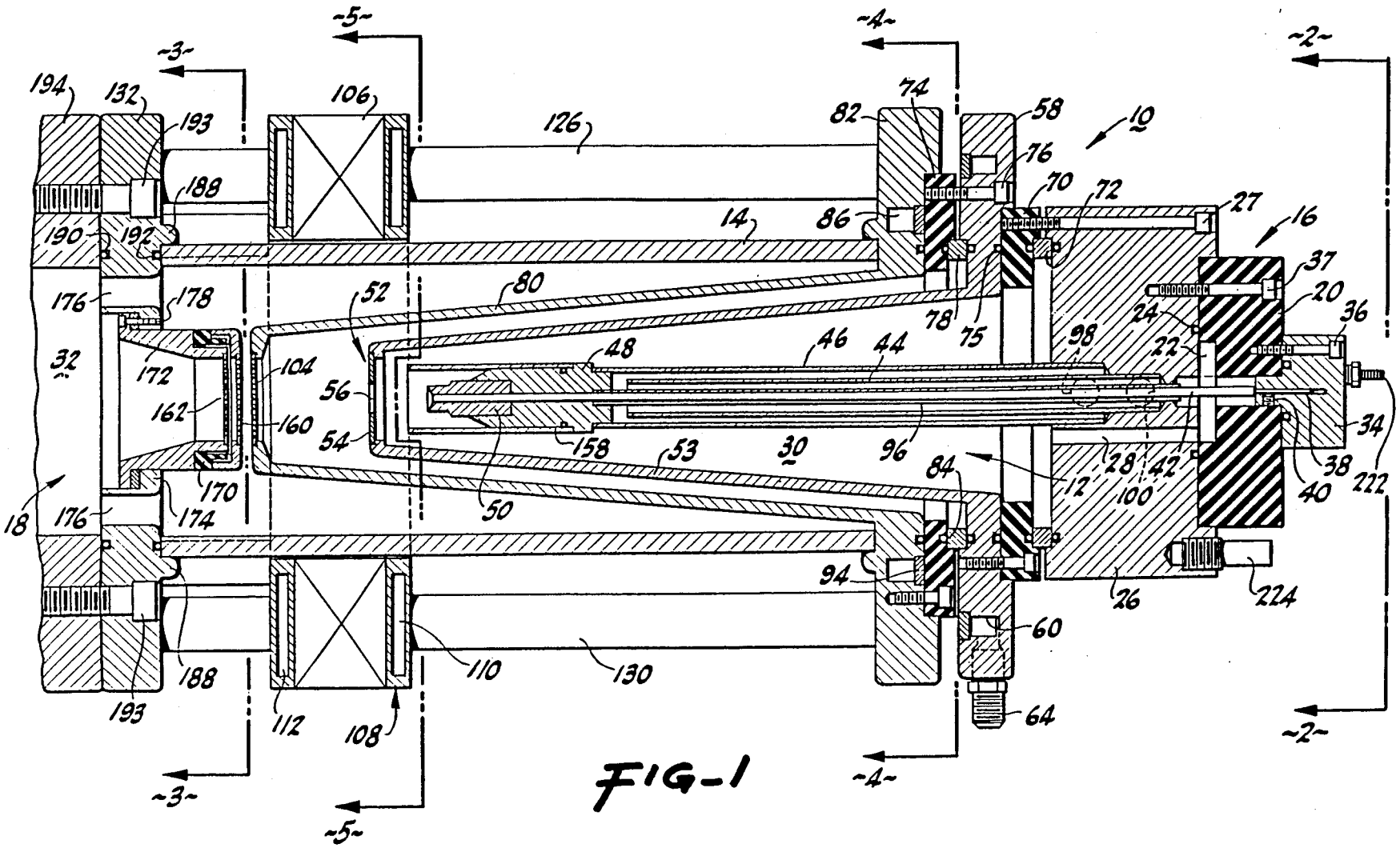
FIG. 1 is an axial sectional view of the apparatus of the present invention.

For a better understanding of the invention reference is made to the herinafter delineated preferred embodiments of the present invention which will be referenced to the hereinabove described drawings.

DESCRIPTION OF THE PREFERRED EMBODIMENTS

Various aspects of the present invention will evolve from the following detailed description of the preferred embodiments thereof which should be referenced to the herinabove described drawings.

The apparatus as a whole is shown in the drawings by reference character 10 and includes as one of its elements a vacuum chamber 12. Vacuum chamber 12 is formed between cylindrical member 14, first end portion 16, and second end portion 18 of apparatus 10. Cylindrical member 14 may be constructed of quartz or other suitable material. Insulator 20 provides a vacuum space 22 which is sealed by 'O' ring 24. Metallic member 26 includes a passage 28 between vacuum space 22 and vacuum space 30 of vacuum chamber 12. Insulator 20 fastens to metallic member 26 via screws 37. Evacuation of vacuum chamber would take place at second end portion 18 of apparatus 10 in vacuum space 32. Metallic member 34 is fastened to insulator 20 via plurality of screws 36, FIGS. 1 and 2. Control electrode 38 is held in metallic member 34 by set screw 40. Metallic members 26 and 34 may be constructed of copper while trigger electrode 38 may be constructed of tantalum, which is resistant to deterioration under high heat. Insulator 42, composed of material, such as alumina, surrounds control electrode 38 along its length extending from metallic member 34. Tubes 44 and 46 are concentrically disposed in relation to insulator 42 and may be constructed of heat conductive material such as copper. Base piece 48 abuts tube 46 and serves as a seat for cathode 50. Anode 52 is formed of electrically conductive material such as aluminum, stainless steel and the like and terminates in an anode plate 54 having opening 56 therethrough. Anode 52 has a conical holder 53 which terminates in a flange or plate 58, FIGS. 1 and 2. Flange 58 includes an annular opening 60 having a plug 62 for separating the inlet 64 and outlet 66 for the coolant, such as freon. Annular groove 60 is capped by filler 68. Insulator 70 abuts flange 58 and anode holder 53. Metal ring 72 lies between metallic member 26 and insulator 70. Plurality of 'O' rings 75 seals metallic member 26, ring 72, insulator 70 and anode flange 58 against leakage of ambient air into vacuum chamber 12. Member 26 fastens to insulator 70 with screws 27.

Anode flange 58 is fastened to insulator 74 by the use of fastening means 76. Metallic ring 78 lies between flange 58 of anode 52 and insulator 74.

Grid holder 80 surrounds anode holder 53 and includes a flange 82. Flange 82 sandwiches insulator 74 between itself and flange 58 of anode 52. Plurality of 'O' rings 84 seal against leakage in the same manner as 'O' rings 75, heretofore described. Flange 82 includes an annular chamber 86 which permits cooling fluid to circulate therethrough. A plug 88 separates inlet 90 from outlet 92, FIG. 2, similar to the structure described for annular chamber 60 in relation to anode flange 58. Filler 94 provides a seal for annular chamber 86.

Figure 6:
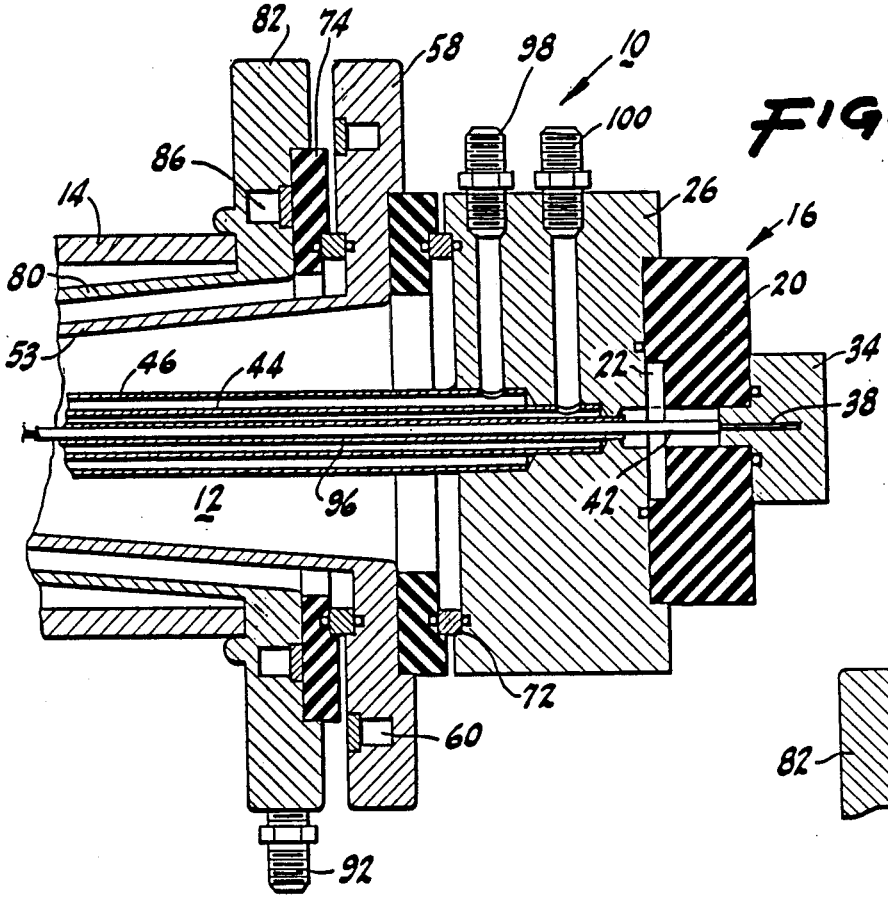
FIG. 6 is a view taken along line 6—6 of FIG. 2.

Turning to FIG. 6, it may be seen that a metallic tube 96 surrounds insulation covering 42 along its length. Coolant is also provided to the space between tube 44 and tube 46 from inlet 98. The coolant impinges on the end of base piece 48, FIG. 1 and returns through the space between tubes 44 and 46 and through outlet 100.

Figure 5:
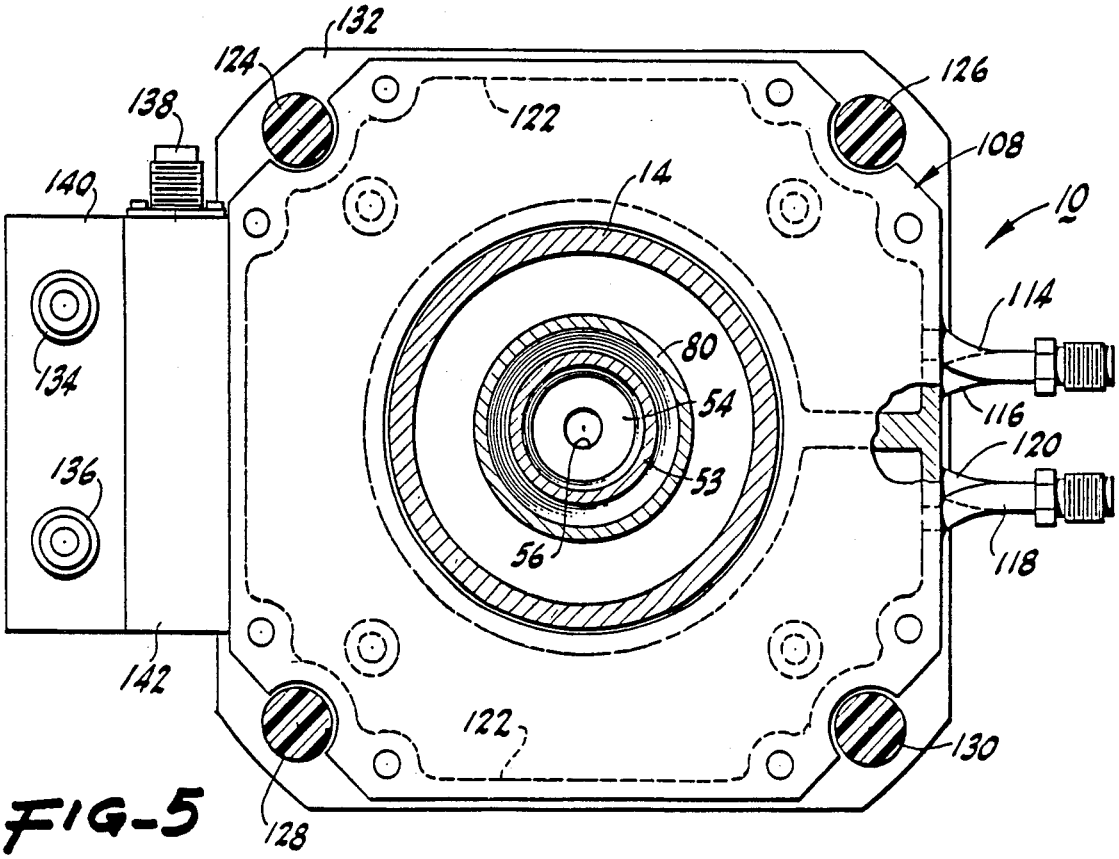
FIG. 5 is a view taken along line 5—5 of FIG. 1.

Grid holder 80 terminates in a stepped member which holds an electrical grid 104. Opening 56, anode 52, cathode 50, and grid 104 are axially aligned. Magnet coil 106 (shown schematically) surrounds the region of anode plate 54. Frame member 108 holds magnet coil in place and consists of a pair of hollow plates 110 and 112 on either side of magnet coil 106. With reference to FIGS. 1 and 5, cooling is also applied to hollow plates 110 and 112 through inlets 114 and 116 and outlets 118 and 120 respectively. Plurality of cylindrical spacers 122 hold plates 110 and 112 together. Likewise, cylindrical bars 124, 126, 128 and 130 hold flange 82 to end plate 132. Electrical terminals 134 and 136 connect the electrical power to magnet coil 106. Terminal 138 serves as a connector to temperature overload switch 228, FIG. 9. These electrical terminals are mounted on blocks 140 and 142, FIG. 5. Further, spacer cylindrical bars 124, 126, 128, and 130 are held to flange 82 and plate 132 via plurality of fasteners 144, FIG. 2, and 146, FIG. 3.

Figure 2:
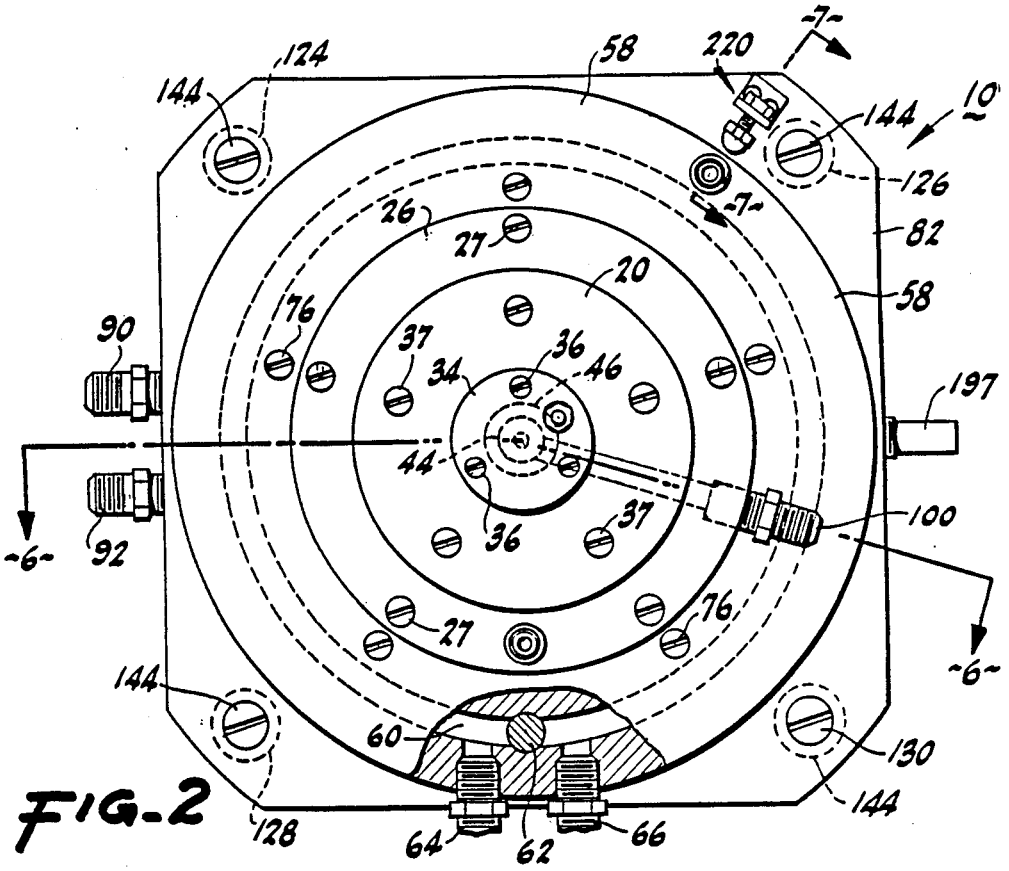
FIG. 2 is a view taken along line 2—2 of FIG. 1.
Figure 7:
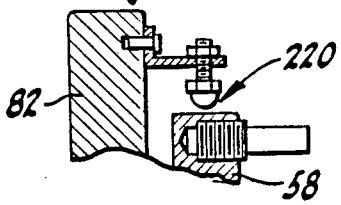
FIG. 7 is a sectional view taken along line 7—7 of FIG. 2.

FIG. 7 depicts a spark gap mechanism 220 which is mounted between plate 82 and flange 58, FIG. 2. Mechanism 220 prevents electrical breakdown between various components of apparatus 10 during electrical conditioning or operation, and confines any spurious discharge to spark gap 220.

Figure 8:
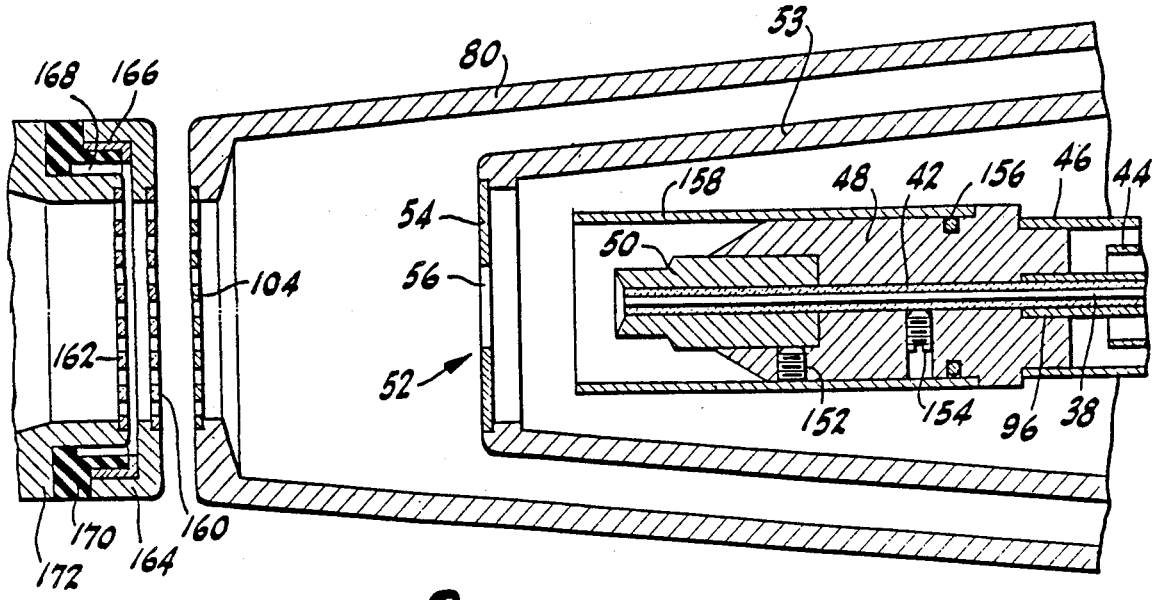
FIG. 8 is an enlarged axial sectional view of a portion of FIG. 1.

Turning to FIG. 8, it should be noted that cathode 50 is held in place within base piece 48 by set screw 152. Another set screw 154 steadies insulator 42 and trigger electrode 38 in base piece 48. 'O' ring 156 holds quartz cylinder 158 around cathode 50.

Figure 3:
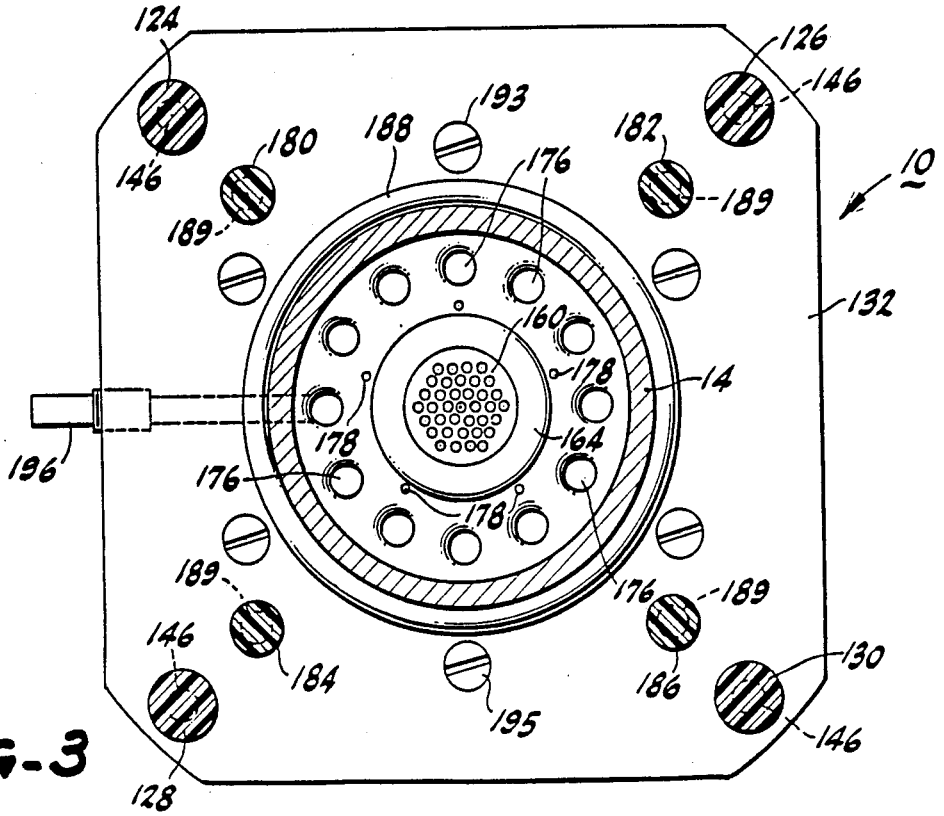
FIG. 3 is a view taken along line 3—3 of FIG. 1.
Figure 4:
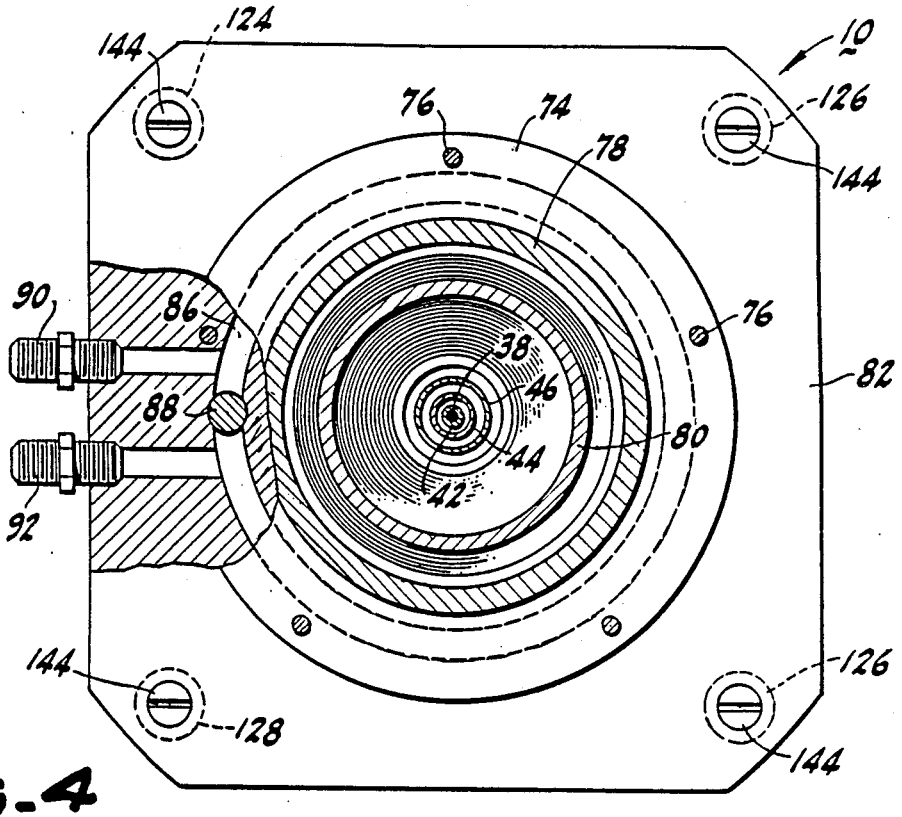
FIG. 4 is a view taken along line 4—4 of FIG. 1.

FIG. 8 also illustrates electrical grids 160 and 162 which are mounted side-by-side with electrical grid 104. With reference to FIGS. 3 and 8, it may be observed that plate 164 and insulator 170 sandwiches plate 166. Hub 172 abuts flange 174 having plurality of openings 176 therethrough. Vacuum space 168 electrically isolates grid 160 from grid 162. Flange 174, the inner portion of plate 132, is held to hub 172 via plurality of fasteners 178. Posts 180, 182, 184 and 186 hold plate 132 to plate 112 of magnetic frame member 108. Plurality of fasteners 189 (shown in phantom on FIG. 3) aid in the holding of plate 132 to magnetic frame 108. Protrusion 188 of plate 132 nests around cylindrical member 14. 'O' rings 190 and 192 hold the vacuum at this point in vacuum chamber 12. Structure 194 represents the ultimate use for the ion beam emerging from apparatus 10. It is assumed that vacuum space 32 would include a portion of structure 194. Fasteners 193 and 195, FIGS. 1 and 3, hold plate 132 to structure 194 and represent a plurality of such fasteners.

Electrical fitting 196 connects to the grid structure hereinabove described. Likewise, electrical fitting 197, FIG. 2, electrically connects to grid holder 80 and grid 104 through grid plate 82.

Figure 9:
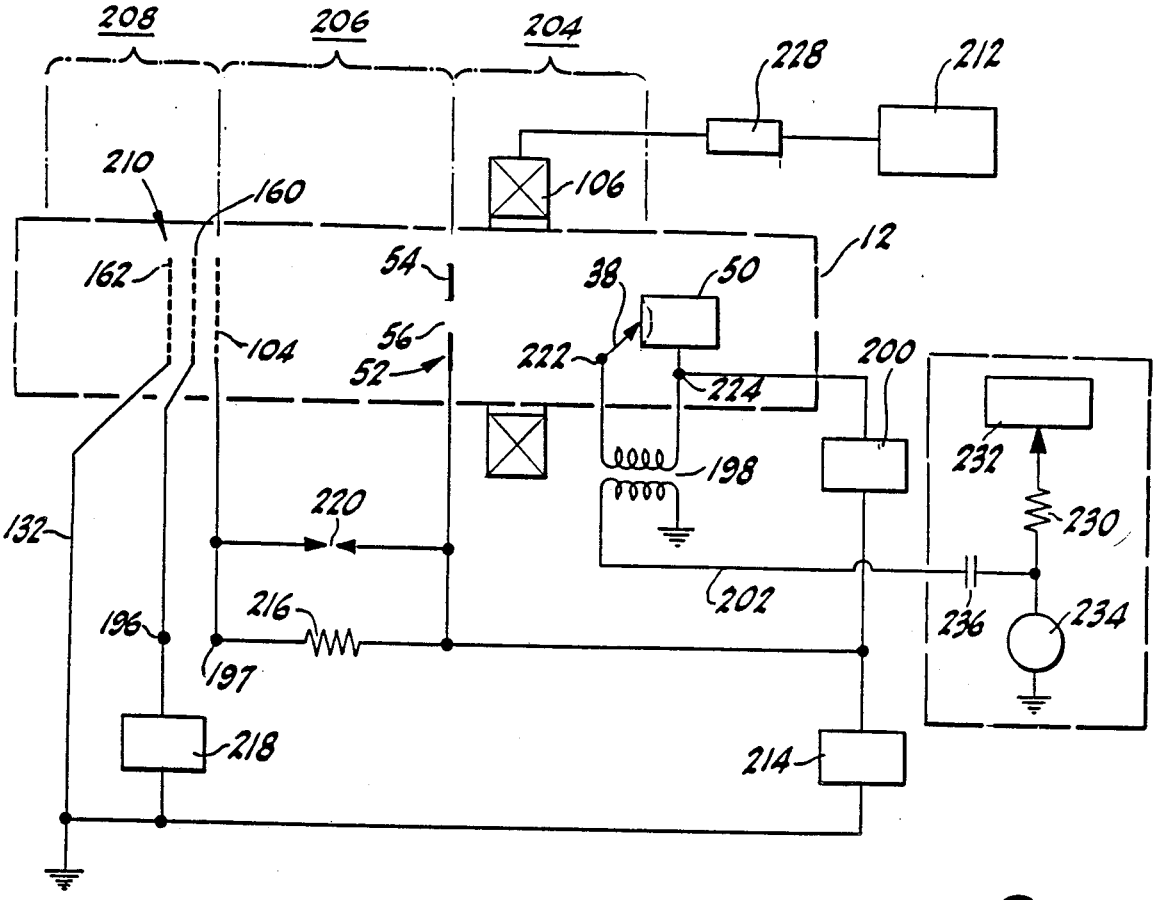
FIG. 9 is a schematic view of the operation of the apparatus of the present invention.

Turning to FIG. 9, it may be apparent that cathode 50 and trigger electrode 38 are connected to pulse transformer 198. A pulse of between 10 and 20 kilovolts is produced between trigger electrode 38 and cathode 50 causing a spark therebetween. This spark initiates an arc between cathode 50 and anode plate 54 within vacuum chamber 12, liberating ionized metal vapor from cathode 50. For example, the cathode material may be tantalum, gold, carbon, aluminum, silicon, titanium, iron, niobium, lathanum hexaboride, uranium, and the like. It has been theorized that "cathode spots", tiny regions of intense current concentration, are responsible for formation of dense metal vapor plasma from cathode 50. Input 202 to pulse transformer 198 may take the form of the circuit illustrated in FIG. 9, utilizing resistor 230, power supply 232, electron tube 234, and capacitor 236.

Figure 10:
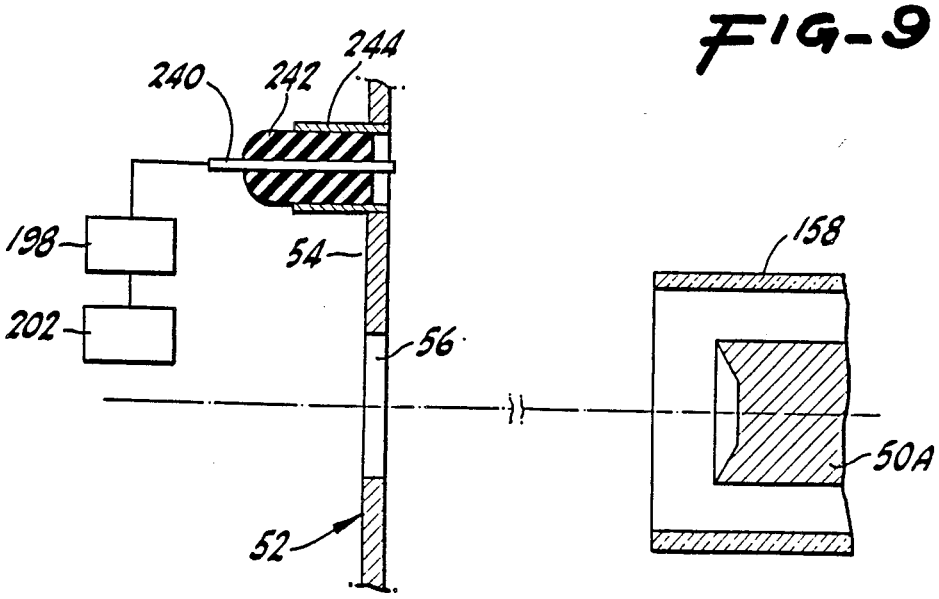
FIG. 10 is a partial sectional view of an alternate embodiment of the present invention.

Alternatively, the metal vapor vacuum arc discharge can be initiated by other means such as focusing a high power, short pulse laser beam onto cathode 50 with approximately the same results. Also, photo-electrons may be liberated from the cathode 50 surface by flooding it with ultra-violet light or soft x-rays created from a nearby trigger spark. For example, FIG. 10 shows an electrode 240 which is held in insulator 242. A metal collar 224 about insulator 242 is welded or otherwise fixed to anode plate 54. Pulse transformer 198 and input circuit 202 may be employed in concert as will be described hereinafter with reference to FIG. 9. Cathode 50A does not include trigger electrode 38 and insulator 42 as does cathode 50.

The space between cathode 50 and anode plate 54 is referred to as the arc region 204. Plasma emanating from cathode 50 streams therefrom toward anode plate 54. Current will flow through the plasma between cathode 50 and anode 52 to complete the electrical circuitry shown in FIG. 9. A magnet field is established by coil 106 to guide the plasma jet from cathode 50 toward anode plate 54 and through opening 56. Annular anode 52 is located perpendicular to the cylindrical axis in the plane of the magnet field coil 106. The field in the region of the anode 52 may be in the order of 1 Kilogauss or less. Coolant such as freon or water passes through inlet 98, tubes 44 and 46, and outlet 100 to remove heat from the arc source.

An intense plasma plume passes through opening 56 in anode 52 into what is termed drift region 206. No impediments are found which would restrict the plasma from passing through opening 56.

Quartz cylinder 158 helps to direct the plasma plume through opening 56 in this regard. Magnet coil 106 utilizes a power supply 212 to further aid in the ducting of the plasma through opening 56. The plasma entering drift region 206 is dense and substantially electrically stable.

The plasma traversing drift region 206 enters extractor region 208 where means 210 is employed for extracting ions from the plasma. Means 210 is depicted in FIG. 9 and includes three grids 104, 160, and 162. Grid 104, the source grid or source electrode, connects to anode plate 54 and extractor power supply 214 through resistor 216. Grid 160, referred to as extractor or suppressor grid, connects to power supply 218. The electric field formed between grids 104 and 160 extracts and accelerates ions from the plasma in drift region 206. Grid 162 is connected to ground.

The ion beam exiting apparatus 10 may be used in accelerators such as the SuperHILAC and the Bevalac as well as for ion implantation in the semiconductor processing and metallurgical fields. The intensity of the beam produced by apparatus 10 is over one Ampere, much greater than existing metal ion beam currents. Such magnitude of the beam current has been confirmed by the Faraday cup and by calorimetric measurements. Although apparatus 10 has been run typically with pulse lengths of between 300 microseconds and 3 milliseconds with repetition rates of up to 10 pulses per second, it is believed that a much longer on-time may be accomplished with a cooling system having a higher capacity; resulting in yet higher ion beam intensities. Continuous (d.c.) operation is feasible, therefore. The charge state distribution of the ions produced by apparatus 10 has been measured and has been repeated in successive runs of apparatus 10. The emittance of ion beam has been measured at 0.05 pi centimeter milliradians (normalized).

With reference to FIGS. 11–15, another emobidment of the invention is shown where a plurality of cathodes 250 are employed in conjunction with trigger electrode 252. Metallic base 254 partially surrounds trigger electrode 252 and is fastened to trigger feedthrough 256. Trigger feedthrough 256 is constructed of electrical conducting material and includes female electrical connection 258. Again, the circuitry employed in the embodiments shown in FIGS. 11–15, to initiate the plasma arc would be identical to the circuitry shown in FIGS. 9 an 10 in conjunction with trigger electrode 38 and cathode 50. Trigger feedthrough insulator surrounds trigger feedthrough 256 and is fastened thereto by fastening means 262. 'O' ring 264 seals trigger electrode 252 within vacuum chamber 266. It should be noted in this regard that chamber 268 is maintained at atmospheric pressure within cowling 270, which is easily removable from anode plate 272. Cathode porting block 274 supports insulator 260 holding trigger electrode 252 by fastening means 276. In turn, cathode porting block 274 fastens to cathode plate 278 by fastening means 280. Cathode plate, in turn, bolts to cathode-anode insulator 282 by the use of fastening means 284. Cathode-anode insulator 282 connects to anode plate 272 by the use of fastening means 286, FIG. 11. Fastening means 262, 276, 280 and 284, may take the form of set screws of conventional design.

Cathode knob 286 is fastened to cathode porting shaft 288 by the use of multiplicity of set screws 290. Electrical receptacle 292 locates at the terminal end of shaft 288 and is intended to feed potential to plurality of cathodes 250. Cathode porting shaft 288 extends through cathode porting block 274 and flairs into a flange portion 294. Porting cap 296 keys to flange portion 294 of shaft 288 by the use of plug or key 298. Porting cap 296 serves as the support for plurality of cathodes 250. Anode mask plate 300 fastens to porting cap 296 by plurality of screws 302. It should be noted, that anode mask plate 300 is an optional component of any emobidments shown in FIGS. 11–15. As depicted, in FIG. 12, anode masking plate 300 is constructed of quartz and includes an opening 304 opposite cathode 306 which is in firing position, FIGS. 11, 12 and 15.

Anode shield 308 includes a plate portion 310 and ring portion 312. Anode shield 308 fixes to shield retainer 314 which is fixed to anode plate 272. Plate portion 310 of anode shield 308, as shown in the drawings, is constructed of quartz material. Ring portion 312 of anode shield 308 has been formed of Pyrex material. Anode shield retainer 314 fixes to anode plate 272 by the use of set screws 317, FIG. 14. Cathode-anode shield 308 hides the potential of anode 316 from all of the plurality of cathodes 250 except the single cathode, such as cathode 306, being fired. In this regard, mask 308 includes an opening 315 which permits passage of the plasma arc from cathode 306 to anode 316.

Figure 12:
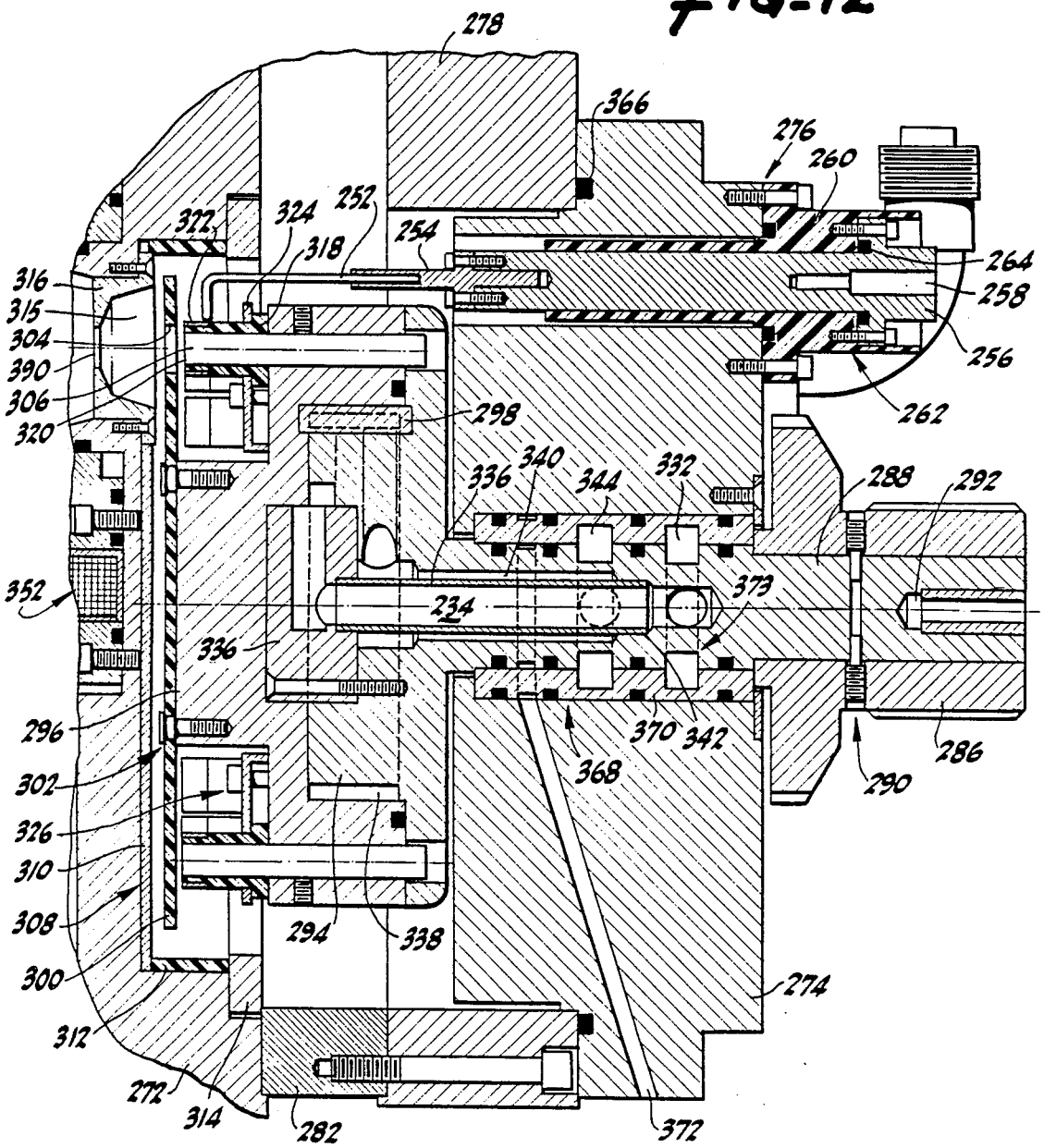
FIG. 12 is a magnified partial sectional of a portion of FIG. 11.

With reference to FIG. 12, it should be noted that cathode 306 includes an insulating sleeve which extends to the tip 320 of cathode 306. A stainless steel ring 322 nests about the terminus of insulator 318. Trigger electrode 252 slidingly engages ring 322 which conducts the electrical potential from electrode 252 to the terminus of ring 322 adjacent the terminus of insulator 318. The spark which initiates the plasma formation travels from the terminus of ring 322 across the terminus of insulator 318 to cathode 306. In this regard, cathode 306, as well as any of the other plurality of cathodes, would exhibit even wear since each cathode would be vaporized at its longest point, i.e. the point closest to anode 316.

Trigger retainer 324 is held in place by plurality of screws 326 which enter porting cap 296.

Figure 11:
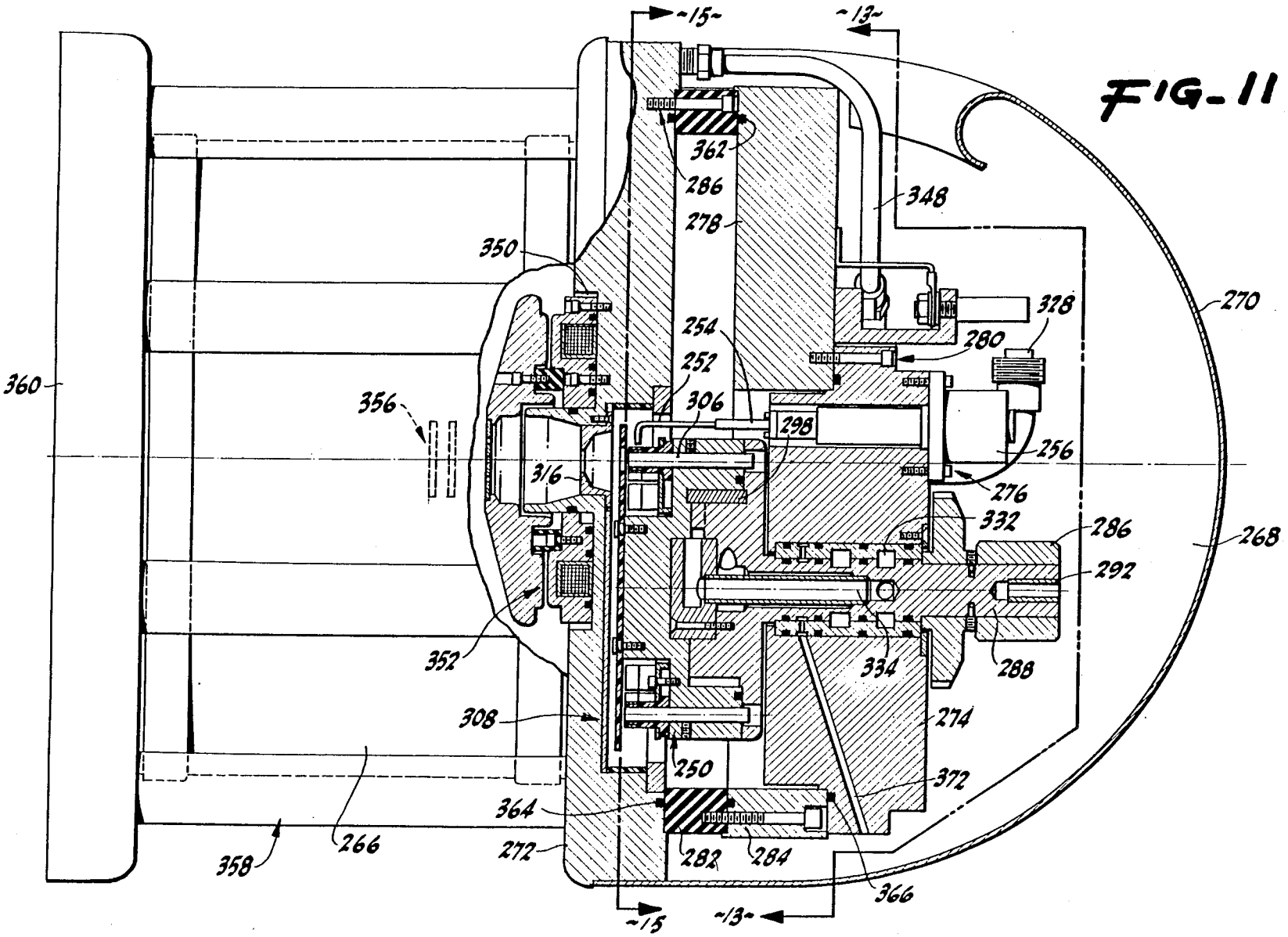
FIG. 11 is a broken away sectional view of another embodiment of the present invention depicting multiple interchangeable cathodes.
Figure 13:
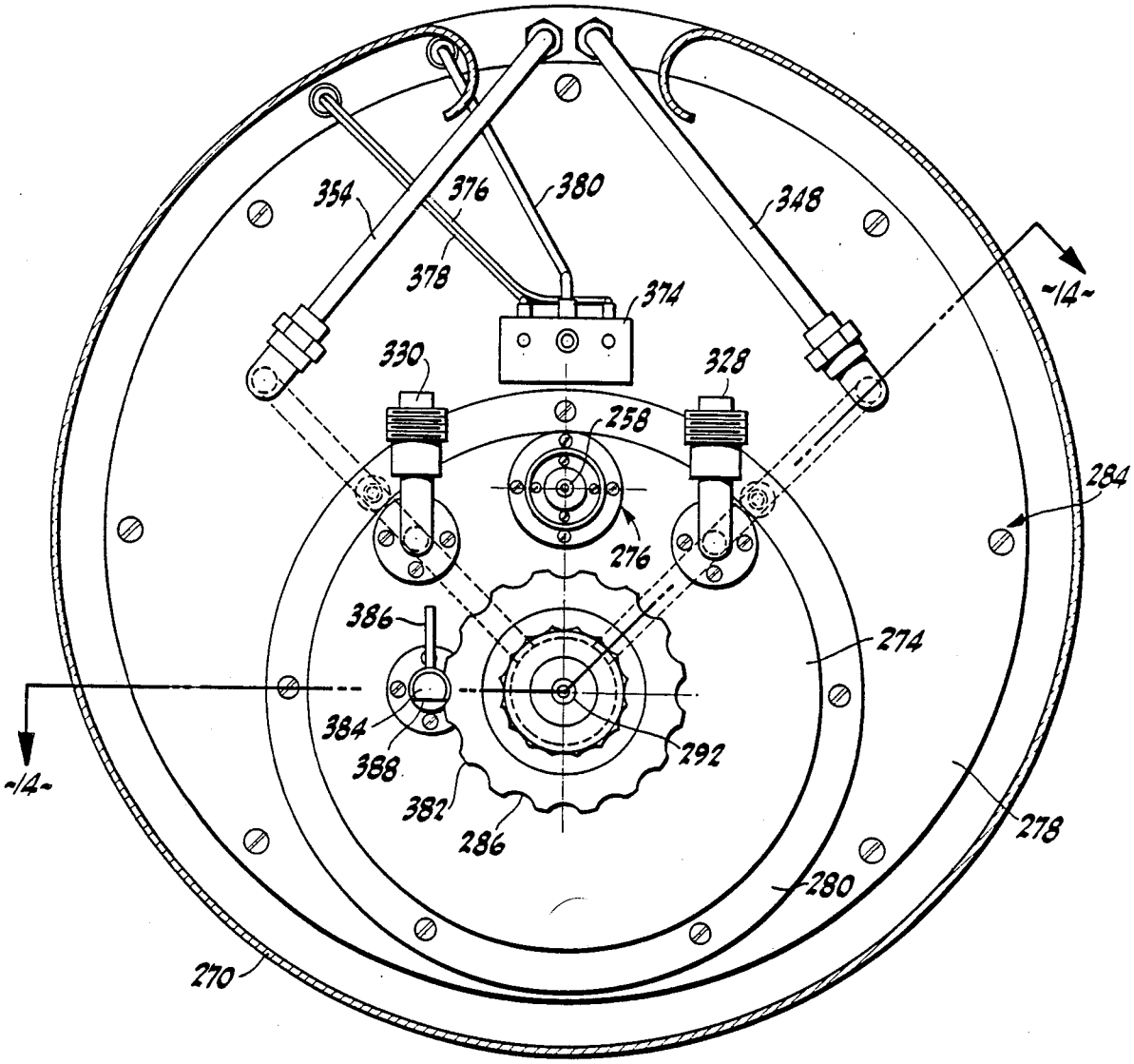
FIG. 13 is a sectional view taken along line 13—13 of FIG. 11.

With reference to FIG. 13, it may be seen that coolant is circulated through the apparatus shown in FIGS. 11–13, by the use of coolant fittings 328 and 330. Coolant is pumped through fitting 328 and enters cathode porting block 274 through passage 332 and a hollow passage 334 through shaft 288. At this point, coolant would pass to porting insert 336 to annular groove 338. Coolant then returns to space 340 on the exterior of porting tube 342. At this point, coolant enters passage 344 and exits fitting 330. It should be noted that coolant is also transported through passage 346, FIG. 14, through conduit 348. Coolant is then passed to anode plate 272 and into annular space 350 to cool the electrode magnet 352. Coolant is then returned through conduit 354 and exits fitting 330.

Electrode magnet 352 and extractor means 356 are essentially similar to magnetic coil 106 and grids 104, 160 and 162, serving as extractor means in the embodiments shown in FIGS. 1–8.

Envelope 358 holds a vacuum on the embodiments shown in FIGS. 11–15. The vacuum is pulled through end piece 360 in this regard. 'O' rings 362, 364, 366, 264, as well as plurality of 'O' rings 368 surrounding Teflon bearing 370 on either side of coolant drain 372, preventing atmospheric pressure from entering chamber 266. Plurality of 'O' rings 373 surrounding passage 332 serve as a seal against coolant leaking from passage 332.

With reference to FIG. 13, it may also be observed that a terminal block 374 mounts on the outer surface of cathode plate 278. Conductors 376 and 378 feed electrical power to magnet 352. Conductor 380 provides the proper potential to anode 316.

Cathode knob 286, FIGS. 13 and 14, includes a scalloped outer perimeter 382 whose recesses fit within a cylindrical locking member 384. Wing 386 connected to cylindrical member 384 serves as a gripping member for the user. Cylindrical member 384 includes a flattened portion 388 which does not contact the flattened portions on outer perimeter 382 of cathode knob 286. Thus, turning cylindrical locking member 384 permits cathode knob 286 to turn when flattened portion 388 of cylindrical knob is essentially parallel to the flattened portions of cathode knob outer perimeter 382. As depicted in FIGS. 13 and 14, cathode knob 286 is locked in a position which permits cathode 306 to properly align with anode 316.

Although multiplicity of cathodes 250 are rotatable within chamber 266, such multiplicity of cathodes may be movable linearly, or otherwise, to achieve plasma formation in conjunction with anode 316.

In operation, in the embodiments shown in FIGS. 1–10, electrical terminals 222 and 224 are connected to pulse transformer 198. Terminal 224 connects to the cathode 50 while terminal 222 connects to the trigger electrode 38. Terminal 226 connects to the positive leads of the arc and extractor power supplies 200 and 214, and to resistor 216 intermediate anode plate 54 and grid 104. Fittings 196 and 197 connect to grids 160 and 104 respectively. Grid 162 is grounded through plate 132. At this point, coolant is circulated through flange 58 of anode holder 53, flange 82 of grid holder 80, and copper tubes 44 and 46. Coolant is also circulated through magnet frame 108 and through fittings 114, 116, 118 and 120. Magnet coil 106 activates via terminals 134 and 136. Temperature shut-off switch 228 now monitors the temperature of coil 106. Power supplies 200, 212, 214 and 218 are turned "on". Pulsing circuit 202 begins the firing of trigger electrode 38 at a rate of several per second. A spark between electrode 38 and cathode 50 initiates the arc between cathode 50 and anode plate 54. A small portion of cathode 50 is ionized at this time. The arc or discharge between cathode 50 and anode plate 54 grows from this spark. Power supply 200 provides a pulsed power supply which determines the duration of the arc between cathode 50 and anode plate 54. Power supply 200 may, in certain cases, provide a steady source of electrical energy to the cathode 50, but the cooling mechanism heretofore described must possess a higher capacity from the present embodiment. The arc or discharge passes through anode opening 56 and travels to extractor means 210. At grid 104, a boundry between the plasma and non-plasma occurs. Menisci form at the openings of grid 104 and are convex toward drift region 206. Such menisci are so shaped as a result of an electric field between grids 104 and 160. Electrons in the plasma plume in drift region 206 remain there. The electric field between grids 160 and 162 repels electrons originating in structure or target 194. This is necessary to prevent back-streaming electrons from overloading extractor power supply 214, breaking down the gap between grids 104 and 160, and generally degrading the performance of apparatus 10. The ion beam emerging from apparatus 10 may be employed as desired.

The following is a table of components typically used in the circuitry shown in FIG. 9:

| ITEM | MODEL # | SOURCE |
|---|---|---|
| Pulse transformer 198 | TR136B | EG & G Boston, MA. |
| Arc power supply 200 | "Pulse & Digital Cir." Chpt. 10, pg. 291–304 | Millman and Taub McGraw Hill 1956 |
| Magnetic power supply 212 | DCR40-250A | Sorenson Co. Manchester, N.H. |
| Extractor power supply 214 | BRE30-800 | Universal Voltronics Corp. Mount Kisco, N.Y. |
| Resistor 216 | 500 OHM 10 watt | Ohmite Co. Skokie, ILL. |
| Suppressor power supply | HV-1544 | Power Designs Co. Palo Alto, CA. |
| Resistor 230 | 1 MOHM 10 watt | Ohmite Co. Skokie, ILL. |
| Power supply 232 | HV-1584R | Power Designs Co. Palo Alto, CA. |
| Electron tube 234 | 5C22 Thyratron | I.T.T Easton, PA, |
| Capacitor 236 | 0. IMF 15 KV | G.E. Schnectady, N.Y. |

The embodiments shown in FIGS. 11–15, may be operated by turning the outer perimeter 382 of cathode knob 286 after unlocking by turning cylindrical member 384. Cathode 306 would then be aligned with trigger electrode 252 such that electrode 252 contacts conductor ring or collar 322. A vacuum would then be produced within chamber 266, which would extend to the region adjacent cathode 306 and anode 316. Coolant would be pumped through fittings 328 and 330 and electrical potential would be provided to electrode 252, cathode 306, anode 316, electrode magnetic means 352 and extractor means 356, as heretofore described in the embodiments shown in FIGS. 1–10 of the invention. An electrical arc would then be produced between cathode 306 and anode 316 triggered by a spark between conductor collar or ring 322 and the end of cathode 306. The plasma produced by vaporizing a portion of cathode 306 would then be guided toward anode 316 and through opening 390. Magnetic means 352 would confine the plasma in order to permit it to travel to extractor means 356. An ion beam would then exit end piece 360, as in the prior device.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An apparatus for generating an ion beam comprising:

a. a vacuum enclosure;

b. a support member having at least a movable portion located in said vacuum chamber;

c. a plurality of cathodes located on said movable portion of said support member, said plurality of cathodes being spaced from one another on said movable portion of said support member;

d. an anode located in one region of said vacuum chamber;

e. means for transporting said movable portion of said support member and any one of said plurality of cathodes located on said support member to a selected distance from said anode in said one region of said vacuum chamber;

f. a source of electrical power defining an electrical potential between said one of said cathodes and said anode;

g. means for producing an electrical arc between said one of said cathodes, located a selected distance from said anode, and said anode sufficient to vaporize and ionize a portion of said cathode to form a plasma;

h. means for guiding said plasma away form said one of said cathodes and anode in said one region of said vacuum chamber, in a predetermined direction to another region of said vacuum chamber spaced from said one of said cathodes and said anode; and i. means for extracting ions from said plasma in said another region of said vacuum chamber spaced from said one of said cathodes and said anode.

2. The apparatus of claim 1 in which said means for producing an electrical arc between said one of said cathodes and said anode includes a trigger electrode connected to a source of electrical voltage, said trigger electrode being positioned adjacent said one of said cathodes transported to a selected distance from said anode in said one region of said vacuum chamber.

3. The apparatus of claim 1 in which said transporting means includes a disc rotatable on a shaft, and means for turning said shaft, each of said plurality of cathodes being located on said rotatable disc.

4. The apparatus of claim 3 in which said means for turning said shaft includes a gripping member linked to said shaft and extending outside said vacuum chamber.

5. The apparatus of claim 4 in which said gripping member includes locking means for fixing said gripping member in a selected position.

6. The apparatus of claim 1 which additionally comprises means for cooling said support member.

7. The apparatus of claim 1 in which said means for extracting ions from the plasma is placed within said vacuum chamber a selected distance from said cathode and said anode.

8. The apparatus of claim 1 in which said means for producing an electrical arc includes a trigger conductor and a conductive trigger collar at least partially surrounding said cathode, said trigger conductor contacting said trigger collar when said one of said cathodes lies at said selected distance from said anode.

9. The apparatus of claim 8 which additionally comprises an insulation member interposed said trigger collar and said cathode.

10. The apparatus of claim 1 which additionally comprises an electrical shield interposed said plurality of cathodes and said anode, said shield providing an opening opposite said anode and said one of said plurality of cathodes when said one of said plurality of cathodes lies at said selected distance from said anode.

* * * * *